US006968067B2

(12) United States Patent
Lopez

(10) Patent No.: US 6,968,067 B2
(45) Date of Patent: Nov. 22, 2005

(54) PORTABLE ENTERTAINMENT SYSTEM

(76) Inventor: Patrick Lopez, 127 Kaeleloi Pl., Honolulu, HI (US) 96821

( * ) Notice: Subject to any disclaimer, the term of this patent is extended or adjusted under 35 U.S.C. 154(b) by 401 days.

(21) Appl. No.: 10/395,571

(22) Filed: Mar. 24, 2003

(65) Prior Publication Data

US 2004/0190741 A1 Sep. 30, 2004

(51) Int. Cl.[7] ..... H04R 25/00

(52) U.S. Cl. ..... 381/334; 381/345; 381/349; 381/182

(58) Field of Search ..... 381/87, 89, 332–335, 381/300, 301, 304, 305, 182, 186, 386–388, 381/345, 349–351, 189, 391; 181/144, 145, 181/147, 155, 156, 199; 348/838; 358/1.15, 358/479

(56) References Cited

U.S. PATENT DOCUMENTS

| | | | | |
|---|---|---|---|---|
| 3,183,305 A | | 5/1965 | Jespersen | |
| 4,396,941 A | | 8/1983 | Nishimura et al. | |
| 4,437,539 A | | 3/1984 | Festa | |
| 4,535,475 A | | 8/1985 | Ward | |
| 4,576,578 A | | 3/1986 | Parker et al. | |
| 4,719,513 A | | 1/1988 | Peterson | |
| 4,755,881 A | | 7/1988 | Bartlett | |
| 4,811,403 A | * | 3/1989 | Henricksen et al. | 381/87 |
| 4,843,624 A | | 6/1989 | Rashak | |
| D310,075 S | | 8/1990 | Mannion et al. | |
| 5,091,791 A | | 2/1992 | Mitchell | |
| 5,324,896 A | * | 6/1994 | Magnani | 181/144 |
| 5,514,841 A | | 5/1996 | Rochon | |
| 5,781,853 A | | 7/1998 | Johnson | |
| 5,818,942 A | | 10/1998 | Freadman | |
| 5,875,255 A | | 2/1999 | Campbell | |
| 6,320,971 B1 | | 11/2001 | Tozawa | |
| 6,504,938 B1 | | 1/2003 | Anderson et al. | |
| 2002/0118314 A1 | | 8/2002 | Pan et al. | |

OTHER PUBLICATIONS

Karaoke-Store.com website pages advertising VocoStar VSCTV-3513 TV/CDG/AM/FM Multifunction Portable Karaoke.

* cited by examiner

*Primary Examiner*—Huyen Le
(74) *Attorney, Agent, or Firm*—Fulbright & Jaworski L.L.P.

(57) ABSTRACT

The subject invention is directed to a portable entertainment system that includes a housing unit and an audio system supported by the housing unit. A transport structure is coupled to the housing unit such that the housing unit is portable. The audio system includes electronic audio equipment and at least a first pair of speakers coupled to the electronic audio equipment. The housing unit contains a speaker enclosure and a support panel is disposed between and substantially parallel to the front and rear panels and the support panel divides the speaker enclosure to form a front air-filled section and a rear air-filled section. A first audio port extends through the housing unit into a front air-filled section of the speaker enclosure and a second audio port extends through the housing unit at least into a rear air-filled section of the speaker enclosure. When a first pair of speakers moves towards the rear panel in response to electrical signals from the electronic equipment, compressed air within the rear air-filled section flows out of a second audio port and when the first pair of speakers moves towards the front panel in response to electrical signals from the electronic equipment, compressed air within the front air-filled section flows out of a first audio port.

16 Claims, 7 Drawing Sheets

PORTABLE ENTERTAINMENT SYSTEM

TECHNICAL FIELD

The invention is directed to a portable entertainment center and more particularly to a transportable housing unit that includes electronic audio equipment and speakers.

BACKGROUND OF THE INVENTION

Several transportable video apparatus are known such as those described in U.S. Pat. No. 4,755,881, directed to a cart that holds and protects a video system from the elements, and U.S. Des. Pat. No. 310,075, directed to a portable video system. U.S. Pat. No. 5,091,791 describes a portable video-photo machine that allows a person being photographed to see how he or she will appear in the photograph prior to printing the photo. Other apparatus are known that include various electronic equipment in a single housing. One such apparatus, described in U.S. Pat. No. 4,396,941, includes a radio receiver, a television receiver, a tape recorder and an electronic calculator. U .S. Pat. No. 5,781,853 is directed to a recreational storage and audio apparatus that is a storage chest that includes an AM/FM radio, a cassette player and a compact disc player in the lid of the chest. Speakers are on the front and side portions of the chest. The chest also includes wheels and a handle. U.S. Pat. Application Publication US 2002/0118314 A1 describes modular television that can include a module rack for holding a digital video-cassette recorder, an internet connection module, a game module, and a MP3 module.

However, none of these devices provides for a portable entertainment system that incorporates the electronic equipment necessary to provide for a stand alone theater with high quality sound.

It would be desirable to provide a portable entertainment system that includes a CD player, an FM/AM tuner, a DVD player and multiple speakers.

It would further be desirable to provide for a portable entertainment system having a pair of speakers enclosed within a first and second substantially enclosed section that provides a high quality sound in any environment.

BRIEF SUMMARY OF THE INVENTION

The subject invention is directed to a portable entertainment system that includes a housing unit and an audio system supported by the housing unit. A transport structure is coupled to the housing unit such that the housing unit is portable. The audio system includes electronic audio equipment and at least a first pair of speakers coupled to the electronic audio equipment. The housing unit contains a speaker enclosure defined by front and rear panels, top and bottom surfaces and opposing first and second side panels adjoining the front and rear panels. A support panel is disposed between and substantially parallel to the front and rear panels and the support panel divides the speaker enclosure to form a front air-filled section and a rear air-filled section. The panels are configured to support the first pair of speakers thereon such that a first portion of each speaker is exposed to the front air-filled section and a second portion of each speaker is exposed to the rear air-filled section.

A first audio port extends through the housing unit into the front air-filled section of the speaker enclosure and a second audio port extends through the housing unit at least into the rear air-filled section of the speaker enclosure. When the first pair of speakers moves towards the rear panel in response to electrical signals from the electronic equipment, compressed air within the rear air-filled section flows out of the second audio port and when the first pair of speakers moves towards the front panel in response to electrical signals from the electronic equipment, compressed air within the front air-filled section flows out of the first audio port.

The audio equipment can include equipment such as a CD player, an AM/FM tuner, a DVD player, a videocassette player and an MP3 player. A projector can also be included in the housing unit of the portable entertainment system.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE INVENTION

The present invention is directed to a portable entertainment system that is configured to provide a stand alone theater. The housing unit of the portable entertainment system includes wheels and handles that allow for complete portability of the system. The system can include for example, a CD, DVD and MP3 player and an image projector which are operable with one remote control device. The speakers in the entertainment system provide for theater sound regardless of the environment. The system can also provide for multimedia and NET conferencing and can be configured to be XM ready.

The portable entertainment system 10 includes a housing unit 12 and an audio system supported by the housing unit as illustrated in FIGS. 1–6. The audio system is comprised of various electronic equipment interconnected by an electronic circuit system 14. The housing unit 12 is a substantially rectangular-shaped box that can be formed from materials such as wood, rigid plastics, metal or a combination thereof. Regardless of the material, the housing unit 12 is preferably waterproof.

Figure 5:
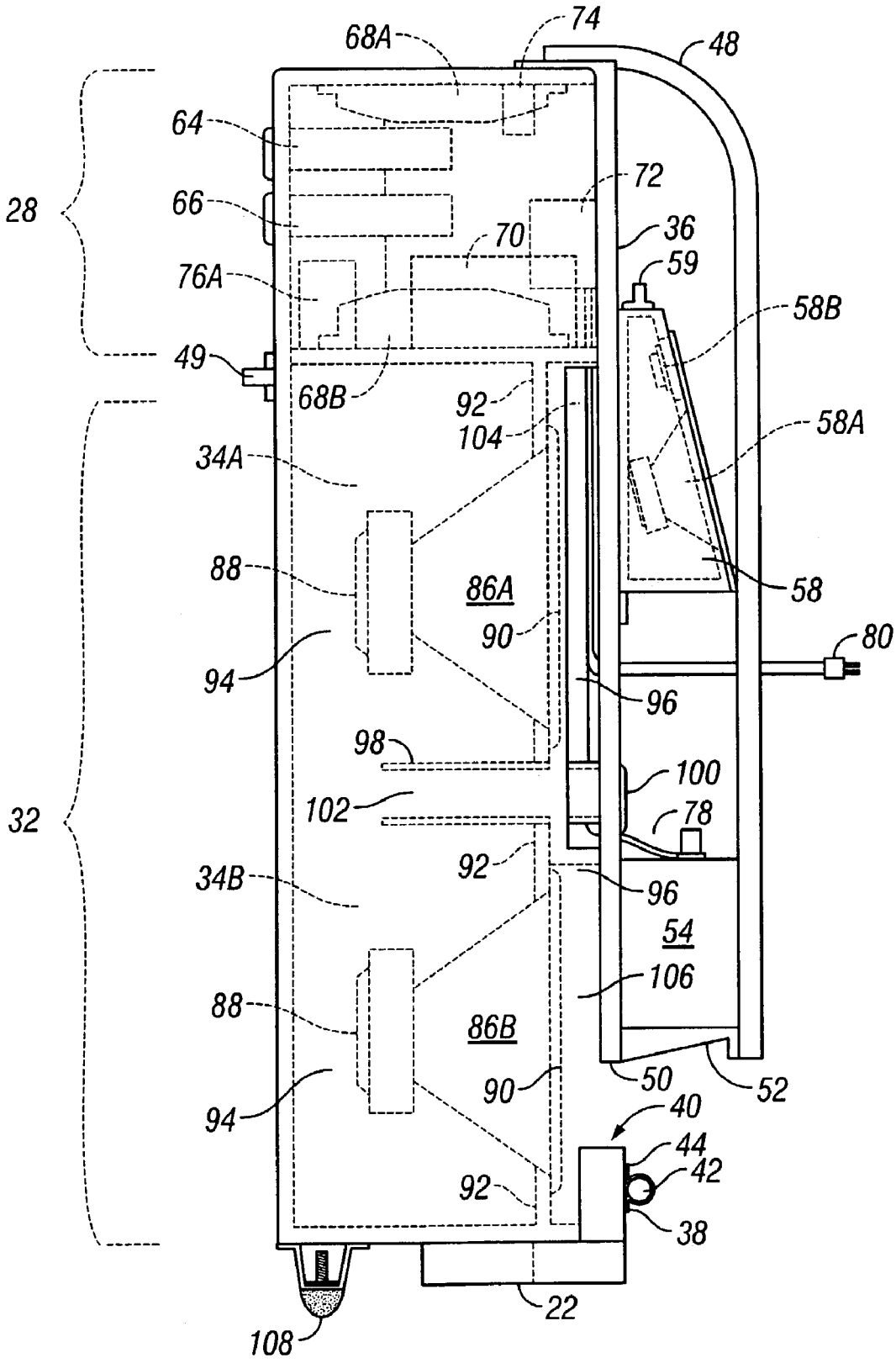
FIG. 5 is a cross-sectional side view along lines 5—5 of the entertainment system of FIG. 2.

The housing unit 12 is defined by front and rear panels 16, 18, top and bottom surfaces 20, 22 and opposing first (left) and second (right) side panels 24, 26 adjoining the front and rear panels 16, 18 (FIGS. 1–3) The housing unit 12 includes two sections, an upper section 28 configured to hold various audio and video electronic components and at least one speaker compartment 30 and a lower section 32 configured to form at least one speaker compartment 34 (FIG. 5). The rear panel 18 is preferably in two sections, a relatively long upper section 36 and a short lower section 38. Upper section 36 can include a removable panel 36A (FIG. 3) that allows access to the interior of upper section 28. In one embodiment, the lower section 28 of the rear panel 18 is thicker than the upper section 36 and can be attached to a portion of the bottom surface 22. A gap 40 is formed between the upper and lower rear panel sections 36, 38 (FIG. 5).

Figure 1:
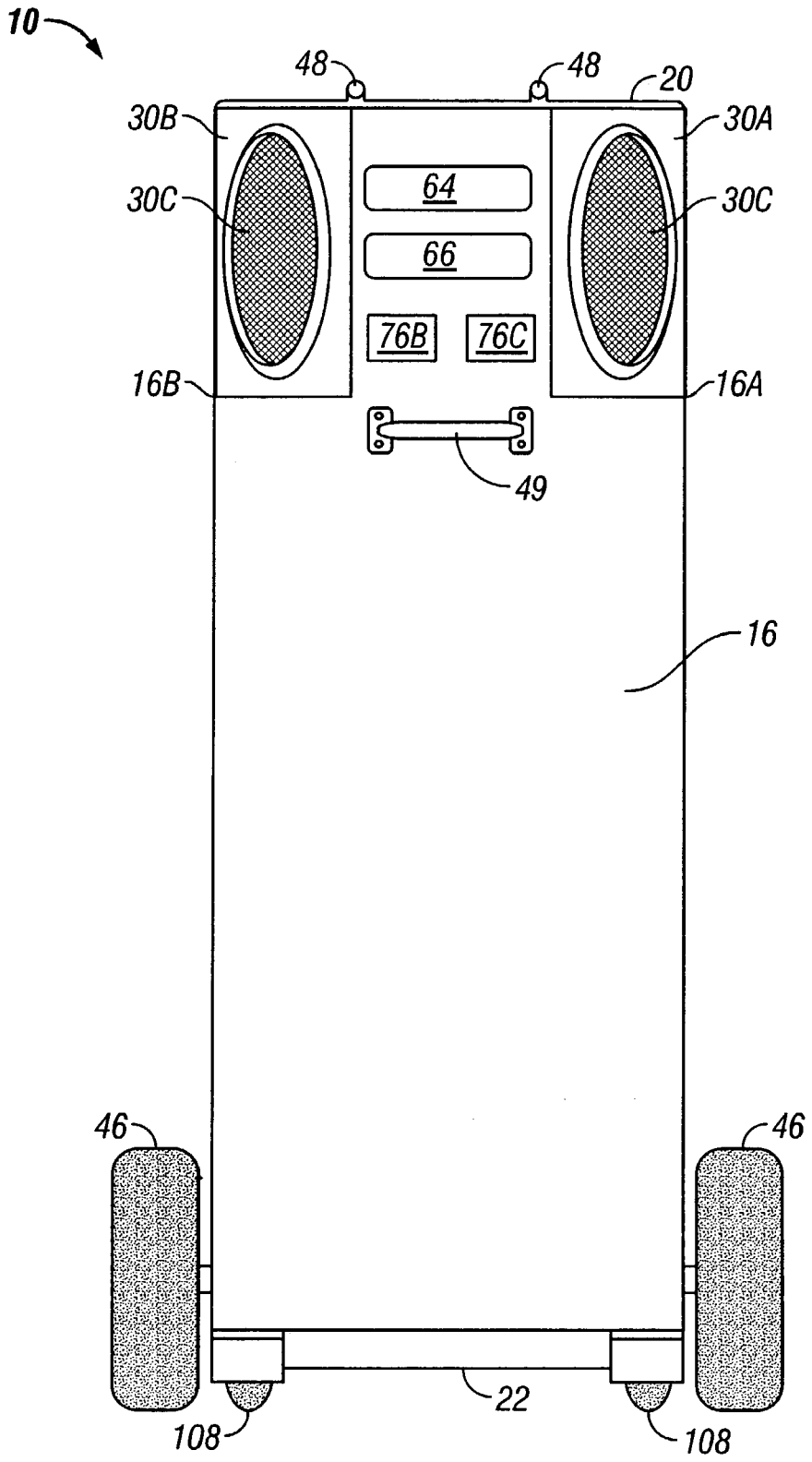
FIG. 1 is a plan front view of the portable entertainment system of the present invention.
Figure 2:
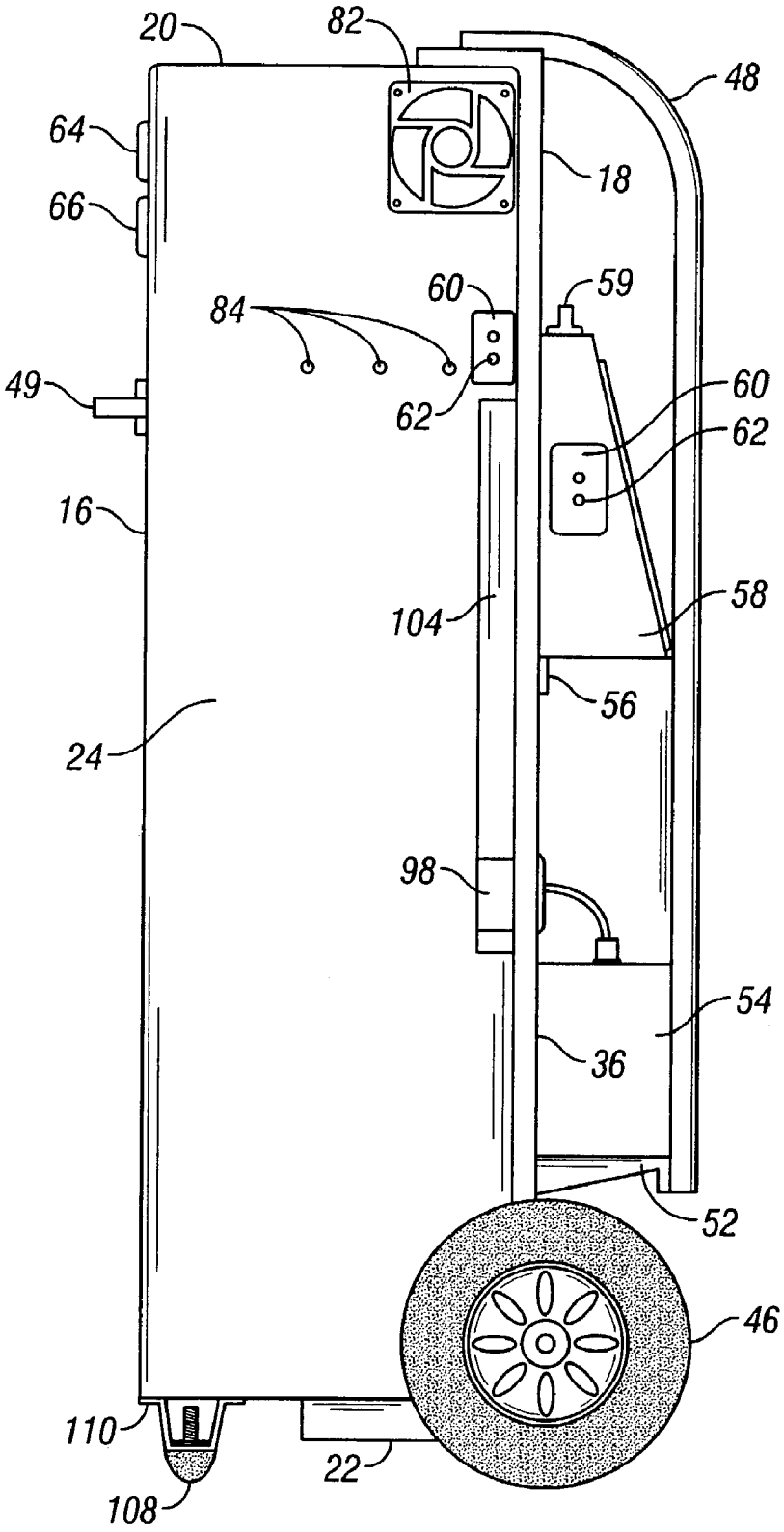
FIG. 2 is a plan left side view of the entertainment system of FIG. 1.
Figure 3:
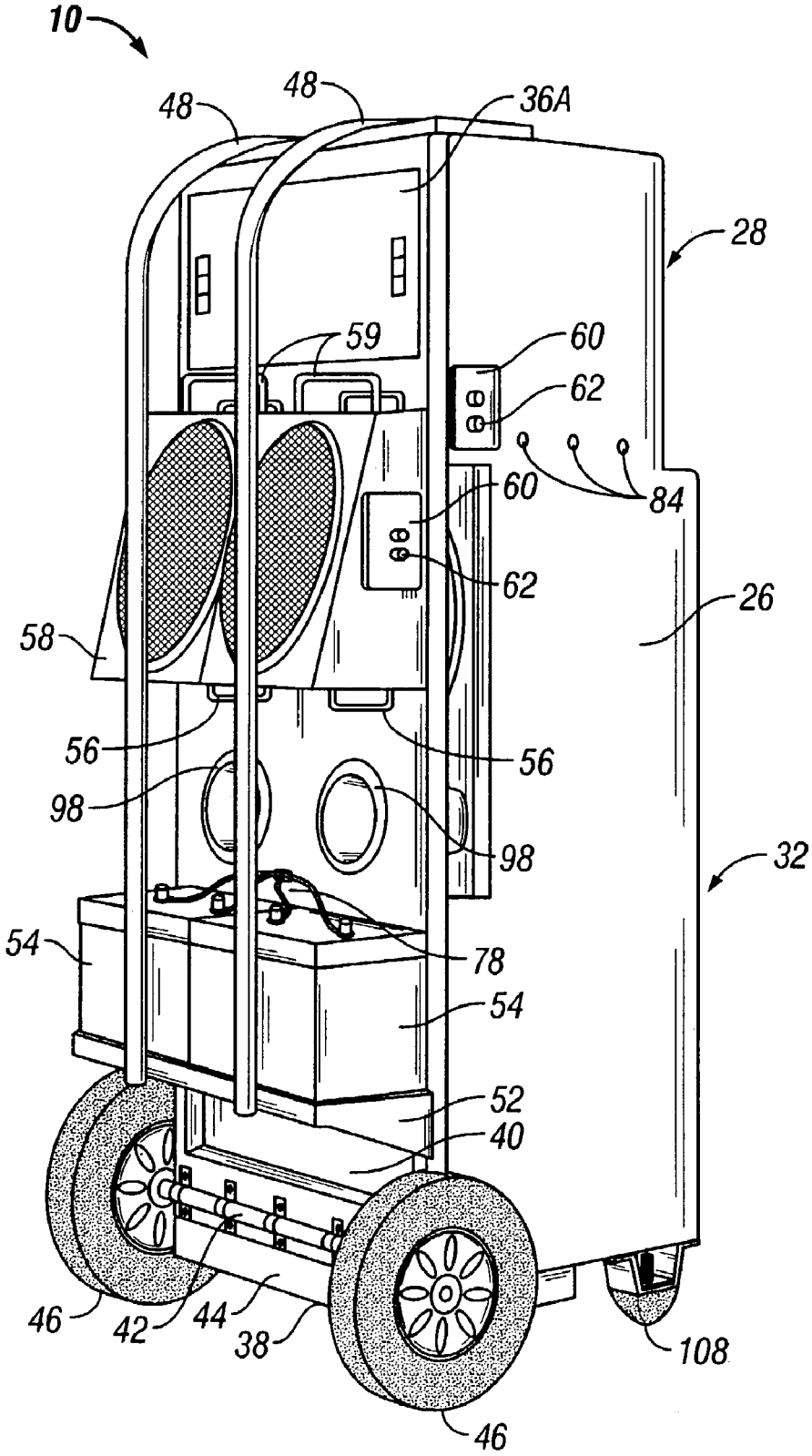
FIG. 3 is a perspective view of the rear side of the entertainment system of FIG. 1.
Figure 4:
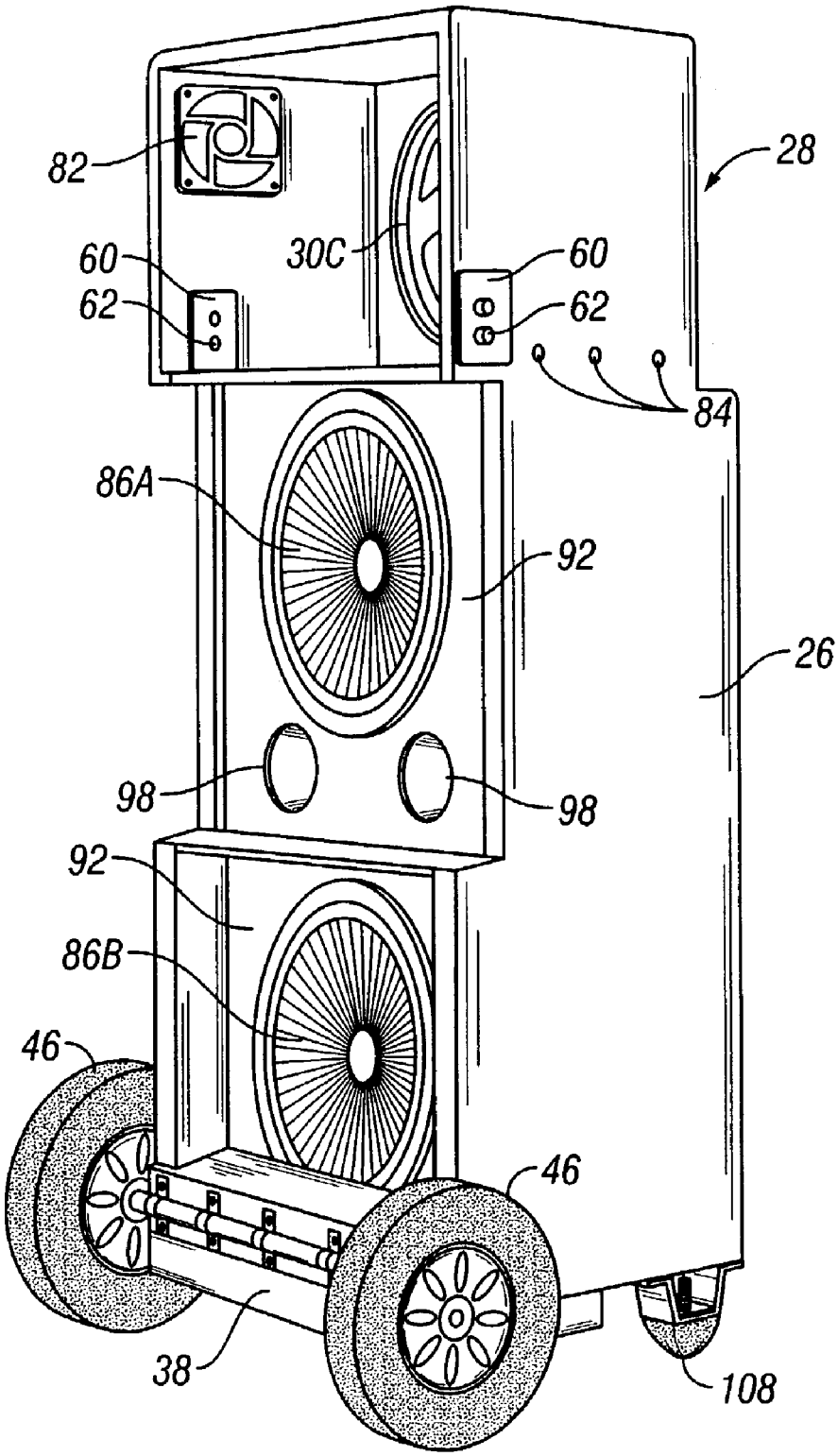
FIG. 4 is a perspective view of the rear side of the entertainment system of FIG. 3 with the rear panel removed.

A wheel axle 42 can be attached either through the bottom rear portion of the housing unit 12 or attached to the outside surface 44 of the lower rear panel section 38. A pair of wheels 46 are attached to the axle 42, a wheel 46 being parallel to each of the first and second side panels 24, 26 (FIG. 2–4). The wheels 46 preferably have a minimum height of 8 inches and are air-filled. A pair of rails or handles 48 are attached to the upper section 36 of the rear panel 18. The pair of rails 48 are positioned parallel to and in vertical alignment with the rear panel 18 and extend from the top surface 20 of the housing unit 12 to the bottom 50 of the upper section 36 of rear panel 18 (FIGS. 2, 3, 5). The wheels 46 and rails 48 provide a transport structure for the housing unit 12 which allows the housing unit 12 to be portable. Additionally, the handles 48 can act as skid bars when the entertainment system 10 is being loaded into or out of a vehicle. In one embodiment, the transport structure can include a handle 49 positioned on the front panel 16 (FIG. 1).

In one embodiment, the upper rear panel 36 can also include a shelf 52 that extends outwardly from the outside surface 54 of panel 36. The shelf 52 is positioned at the bottom 50 of the upper rear panel 36 and extends horizontally along the entire width of rear panel 36. The depth of shelf 52 is such that it can accommodate a rechargeable battery 54 of a kind that is known to one skilled in the art. In one embodiment, a pair of batteries 54 can be positioned on the shelf 52 or alternatively, smaller rechargeable batteries (not shown) can be placed within the housing unit. Preferably, the pair of handles 48 are attached to the outer end 52A of shelf 52 and can hold the pair of batteries 54 in place. The shelf 52 can be fastened to the housing unit 12 with any suitable fastening means (FIGS. 2, 3, 5).

The upper section 36 of the rear panel 18 can also include an attachment mechanism 56 for attaching a pair of detachable speaker components 58 that could house, for example, a pair of middle 58A and high range 58B speakers. The speaker 58 components can be detached from the housing unit 12 and placed a distance from each side panel 24, 26 in order to create a surround-sound effect. Preferably, the detachable speaker components 58 include a RCA jack cover 60 and RCA jack 62 that will enable the components 58 to be connected to the electronics of the audio system. The two speaker components 58 can also include a handle 59, positioned for example, on the top of each component 58 (FIGS. 2, 3, 5).

Figure 6:
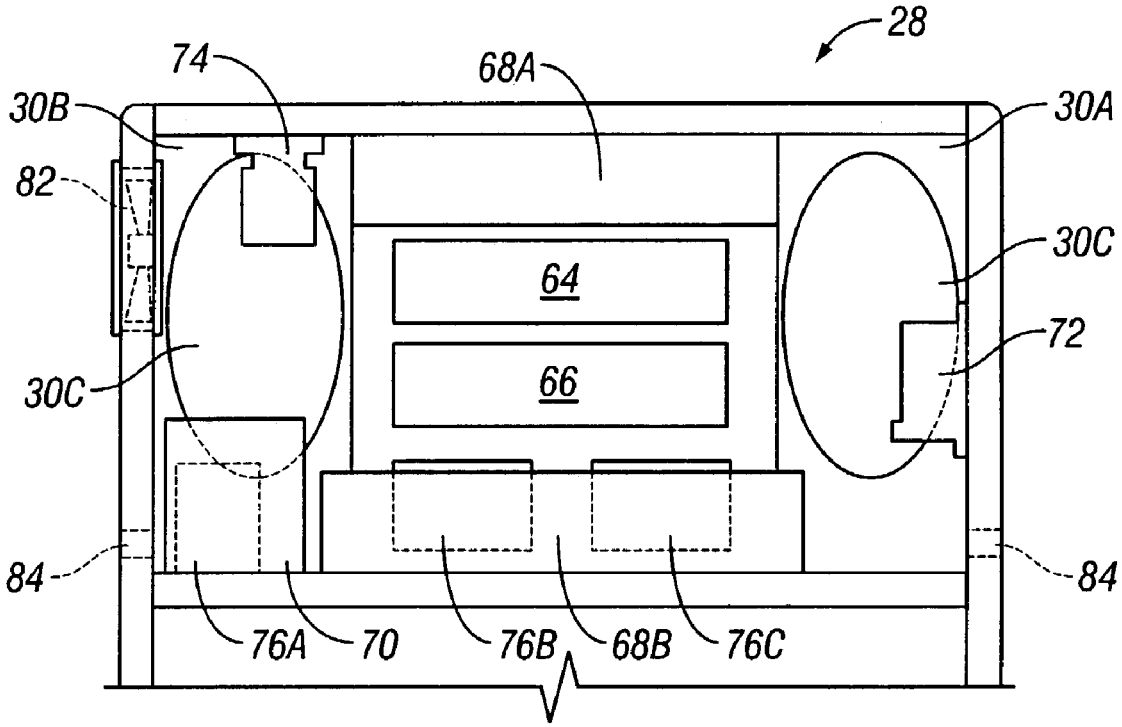
FIG. 6 is a front, partial interior view of the upper portion of the entertainment system of FIG. 1.

The upper section 28 of the housing unit 12 includes at least one mid sized speaker and preferably two mid sized speaker compartments 30A, 30B. The two speaker compartments 30A, B are placed in the front side portions 16A, 16B of the upper section 28 of the housing unit 12. In one embodiment, a middle and high range speaker component 30C is placed in each speaker compartment 30A, 30B. In an embodiment of the subject invention, electronic audio and video equipment can be placed between the two speaker compartments 30A, 30B (FIGS. 1, 5, 6). In one embodiment the electronic equipment includes a CD player 64 and a DVD player 66. Examples of other electronic equipment include a VCD player, a MP3 player, an AM/FM tuner, telephone, television, and an image projector. The electronic equipment is of the kind obtainable from any commercially available source.

The upper section 28 of the housing unit 12 also can include amplifiers 68A, 68B, a capacitor 70, an A/C power converter 72 and associated relay 74, and a battery charger 76A that includes a battery charger selector switch 76B and a battery charger charge level indicator 76C (FIG. 5). In one embodiment, positive and negative battery terminal cables 78 attach to the A/C power converter 72 as well as an A/C power cord 80. A cooling fan 82 and cooling fan drafting ports 84 can also be placed in the side panels 24, 26 of the upper section 28 of the housing unit 12 (FIGS. 2, 4, 5).

The lower section 32 of the housing unit 12 is configured to contain the speaker compartment or enclosure 34 that is defined by front and rear panels 16, 18, top and bottom surfaces 20, 22 and opposing first and second side panels 24, 26 adjoining the front and rear panels 16, 18. The speaker enclosure 34 is configured to hold at least a first speaker 86 and preferably a first and second speaker 86A, 86B forming a first pair of speakers 86A, B. Each first and second speaker 86A, B has a first portion or end 88 and a second portion or end 90 (FIG. 5). A support panel 92 is disposed between and substantially parallel to the front and rear panels 16, 18. The support panel 92 divides the speaker enclosure 34 to form a front air-filled section 94 and a rear air-filled section 96. The front air-filled section 94 is created between the front panel 16 and the support panel 92 and the rear air-filled section 96 is created between the panel 92 and the upper and lower sections 36, 38 of the rear panel 18. The panel 92 is configured to support the first and second speakers 86A, 86B thereon such that the first portion 88 of each speaker is exposed to the front air-filled section 94 and the second portion 90 of each speaker is exposed to the rear air-filled section 96 (FIG. 5). In one embodiment, the first and second speakers 86A, 86B are positioned one above the other. The speakers 86A, B are connected to the electronic equipment and receive electrical signals in order to produce sound as is know to one skilled in the art of electronic audio equipment. In a preferred embodiment, the speakers 86A, B are subwoofers. All of the speakers are of the kind obtainable from any commercially available source.

At least a first audio port 98, and preferably a pair of first audio ports 98, extend through the support panel 92 of the housing unit 12 into the front air-filled section 94 of the speaker enclosure 34. The first audio ports 98 have an elongate body that extends between a first open end 100 located in the upper section 36 of the rear panel 18 and a second open end 102 disposed in the front air-filled section 94 of the speaker enclosure 34 (FIGS. 3–5). In one embodiment, the first audio ports 98 are bass ports. A least a second audio port 104 and preferably a pair of second audio ports 104 is formed by an aperture that is formed in and extends through at least one of the first and second side panels 24, 26 into the rear air-filled section 96 of the speaker enclosure 34. The second audio ports 104 are adjacent to the first speaker 86A. A third audio port 106 is formed by the gap 40 between the upper and lower sections 36, 38 of the rear panel 18, which is positioned in a portion of the rear air-filled section 96 of the speaker enclosure 34. The third audio port 106 is adjacent to the second speaker 86B (FIGS. 2–5).

The speaker design of the subject invention provides for a very high quality sound. This is because of the unique configuration of the speaker enclosure 34. As described above, the speaker enclosure is essentially a closed system except for the pair of first audio ports 98. When the first pair of speakers 86A, 86B moves towards the front panel 16 in response to electrical signals from the electronic equipment, compressed air within the front air-filled section 94 flows out of the first audio ports 98. When the first pair of speakers 86A, 86B moves towards the rear panel 18 in response to electrical signals from the electronic equipment, compressed air within the rear air-filled section 96 flows out of the second and third audio ports 104, 106. Thus, the configuration of the speaker enclosure 34, the speakers 86A, B, the support panel 92, the upper section 36 and the first audio port 98 create an unexpected high quality sound.

The housing unit 12 also includes a pair of adjustable feet 108, one foot 108 being positioned on the bottom of each front corner 110 of the housing unit 12 (FIGS. 1–3). The adjustable feet 108 can be of any kind that would be known to one skilled in the art. The adjustable feet 108 allow the entertainment system 10 to be leveled when sitting on an uneven surface.

Figure 7:
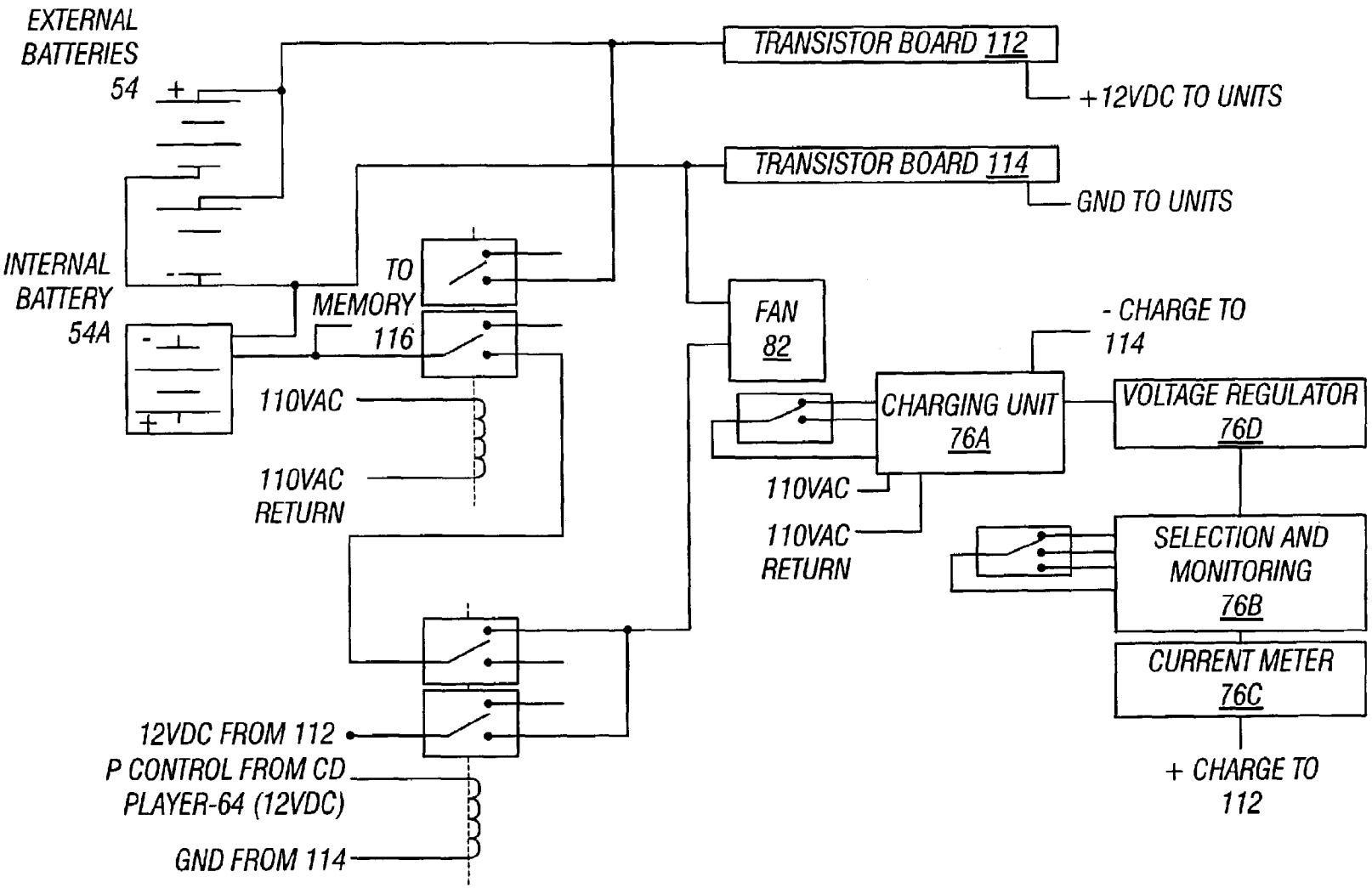
FIG. 7 is an example of one embodiment of a circuit diagram for the entertainment system of FIG. 1.

FIG. 7 is an illustration of an exemplary circuit board for the entertainment system 10. The transistor boards 112, 114 are connected to and control the CD player 64 and the DVD player 66. Other electronic equipment would have their respective transistor boards. The battery charging unit 76A is connected to a voltage regulator 76D, which is connected to the selection and monitoring selector switch and the current meter/charge level indicator. The circuit layout would be know to one skilled in the art of electronics and would depend upon the placement and kind of electronic equipment housed in the entertainment system 10.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A portable entertainment system, comprising:

a housing unit;

an audio system supported by the housing unit, the audio system comprising electronic audio equipment and at least a first pair of speakers coupled to the electronic audio equipment; and a transport structure coupled to the housing unit such that the housing unit is portable, wherein the housing unit comprises:

a speaker enclosure defined by a front panel;

a rear panel;

a top surface;

a bottom surface; and opposing first and second side panels adjoining the front and rear panels;

a support panel disposed between and substantially parallel to the front and rear panels, the support panel dividing the speaker enclosure to form a front air-filled section and a rear air-filled section, and configured to support the first pair of speakers thereon such that a first portion of each speaker is exposed to the front air-filled section and a second portion of each speaker is exposed to the rear air-filled section;

at least a first audio port extending between the front air-filled section of the speaker enclosure and the rear panel; and at least a second and third audio port formed between the support panel and the rear panel of the housing unit;

wherein, when the first pair of speakers moves towards the front panel in response to electrical signals from the electronic equipment, resulting compressed air within the front air-filled section flows out of the first audio port; and wherein, when the first pair of speakers moves towards the rear panel in response to electrical signals from the electronic equipment, resulting compressed air within the rear air-filled section flows out of the second audio port.

2. The system as recited in claim 1, wherein the audio equipment is selected from a group consisting of a CD player, and MP3 player and an AM/FM tuner.

3. The system as recited in claim 1, further comprising video equipment supported by the housing unit.

4. The system as recited in claim 3, wherein the video equipment is selected from a group consisting of a DVD player, VCD player, television and image projector.

5. The system as recited in claim 1, wherein the at least a first pair of speaker comprises a pair of woofers.

6. The system as recited in claim 1, wherein the first audio port comprises at least one bass port having an elongate body extending between a first open end and a second open end, wherein the first open end is located in the rear panel and the second open end is disposed in the front air-filled section of the speaker enclosure, and wherein the second and third audio port comprises at least one aperture formed in and extending through at least one of the first and second side panels into the rear air-filled section of the speaker enclosure.

7. The system as recited in claim 1, wherein the audio system comprises a second pair of speakers supported by the housing unit, and wherein the second pair of speakers are middle and high range speakers.

8. The system as recited in claim 1, wherein the audio system comprises a detachable pair of speakers detachably connected to the rear panel.

9. The system as recited in claim 1, wherein the transport structure comprises an axle and a pair of wheels.

10. The system as recited in claim 1, further comprising a battery system for providing power to the electronic audio equipment.

11. A portable entertainment system, comprising:

a housing unit comprising an equipment enclosure and a speaker enclosure;

an audio system comprising electronic equipment and a first pair of speakers coupled to the electronic equipment, the electronic equipment supported within the equipment enclosure and the first pair of speakers substantially enclosed within the speaker enclosure;

a support structure dividing the speaker enclosure into a first substantially enclosed section and a second partially open section, wherein the first pair of speakers is affixed to the support structure such that a first portion of each speaker is exposed to the first substantially enclosed section and a second portion of each speaker is exposed to the second partially open section;

a first pair of audio ports extending through the housing unit into the first substantially enclosed section of the speaker enclosure; and at least a second pair of audio ports extending through the housing unit into the second partially open section of the speaker enclosure;

wherein, when movement of the first pair of speakers in response to electrical signals from the electronic equipment compresses air in the first substantially enclosed section, the compressed air flows through the first pair of audio ports; and wherein, when movement of the first pair of speakers in response to electrical signals from the electronic equipment compresses air in the second partially open section, the compressed air flows through the at least second pair of audio ports.

12. The system as recited in claim 11, wherein the equipment enclosure includes at least one speaker enclosure.

13. The system as recited in claim 11, wherein the audio system includes audio equipment selected from a group consisting of a CD player, and MP3 player and an AM/FM tuner.

14. The system as recited in claim 11, further comprising video equipment supported by the housing unit.

15. The system as recited in claim 14, wherein the video equipment is selected from a group consisting of a DVD player, VCD player, television and image projector.

16. The system as recited in claim 11, further comprising a battery system for providing power to the electronic equipment.

* * * * *